US006847725B1

(12) United States Patent
Neuman et al.

(10) Patent No.: US 6,847,725 B1
(45) Date of Patent: Jan. 25, 2005

(54) RADIO, INFRARED, AND AUDIO ASSISTIVE LISTENING DEVICE

(76) Inventors: Sandra J. Neuman, 7972A Lexington Club Blvd., Delray Beach, FL (US) 33446; Bernard Neuman, 7972A Lexington Club Blvd., Delray Beach, FL (US) 33446

( * ) Notice: Subject to any disclaimer, the term of this patent is extended or adjusted under 35 U.S.C. 154(b) by 203 days.

(21) Appl. No.: 10/319,235

(22) Filed: Dec. 16, 2002

(51) Int. Cl.[7] ..... H04R 25/00
(52) U.S. Cl. ..... 381/383; 381/385; 381/375
(58) Field of Search ..... 381/383, 385, 381/379, 370, 381, 374, 380, 182; 379/430; 181/128, 129

(56) References Cited

U.S. PATENT DOCUMENTS 4,465,907 A * 8/1984 Minear et al. ..... 381/81
4,633,498 A * 12/1986 Warnke et al. ..... 381/23.1
4,920,570 A * 4/1990 West et al. ..... 381/315
5,438,626 A 8/1995 Neuman
5,495,534 A * 2/1996 Inanaga et al. ..... 381/310
5,506,911 A * 4/1996 Neuman et al. ..... 381/381
5,642,426 A 6/1997 Neuman
5,987,147 A * 11/1999 Nishimoto ..... 381/375
6,230,029 B1 * 5/2001 Hahn et al. ..... 455/575.2

* cited by examiner

*Primary Examiner*—Curtis Kuntz
*Assistant Examiner*—P. Dabney
(74) *Attorney, Agent, or Firm*—Alvin S. Blum

(57) ABSTRACT

An assistive listening device has a housing enclosing at least one of a radio receiver and an infrared radiation receiver for receiving radiation carrying audio information transmitted to hearing impaired members of an audience. The infrared radiation receiver includes three infrared detectors for receiving radiation from at least three different directions. The received radiation is converted to an amplified audio signal that is converted to sound emitted at a pair of earphones that are attached to the distal ends of two arms that are attached at their proximal ends to the housing. The earphones are rotatable on their arms for enhanced comfort. A microphone is attached to the housing. It receives sound and amplifies it to enable the wearer to hear a conversation while wearing the device. It may be rotatable to enhance reception. It may be disconnected to eliminate unwanted noise.

17 Claims, 3 Drawing Sheets

RADIO, INFRARED, AND AUDIO ASSISTIVE LISTENING DEVICE

This invention relates to assistive listening devices for wearing by hearing impaired persons for receiving infrared and/or radio transmissions where such transmissions are provided for the hearing impaired in the audience.

BACKGROUND OF THE INVENTION

Applicants' U.S. Pat. Nos. 5,642,426; 5,506,911; and 5,438,626 disclose devices with folding earphone arms to be worn by the hearing impaired members of an audience in which infrared or radio transmissions of the audio portion of the program are transmitted to the audience. The devices receive the transmissions, convert them into electrical signals, amplify the signals, and convert the signals into sounds at earphones in the ears of the wearer. U.S. Pat. No. 4,633,498 to Warnke et al. teaches a pair of microphones fixedly mounted on the front face of a housing of an infrared headphone device. The microphones are symmetrically arranged with respect to a median plane of the user's head so that sounds originating from that plane can be cancelled. The object is to avoid amplifying the user's voice. Unfortunately, sound, from a person directly facing the user will also be cancelled.

SUMMARY OF THE INVENTION

The devices of the instant invention include the features of the applicant's prior inventions of compact assistive listening devices for infrared and/or radio receiving with folding earphone arms. They further include a microphone and circuitry to amplify the electrical signal from the microphone and convert the signal into amplified sound at the earphones. The microphone may be removable and directional. The microphone is on a housing that is below the chin, where it is positioned to be poorly receptive of the wearer's voice. It enables a hearing impaired user to enjoy conversation while wearing the device. If the user is watching a television program or a theatrical performance that emits infrared audio signals, conversation with others is enhanced. By disconnecting the microphone, distracting conversation of others in the room is eliminated.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
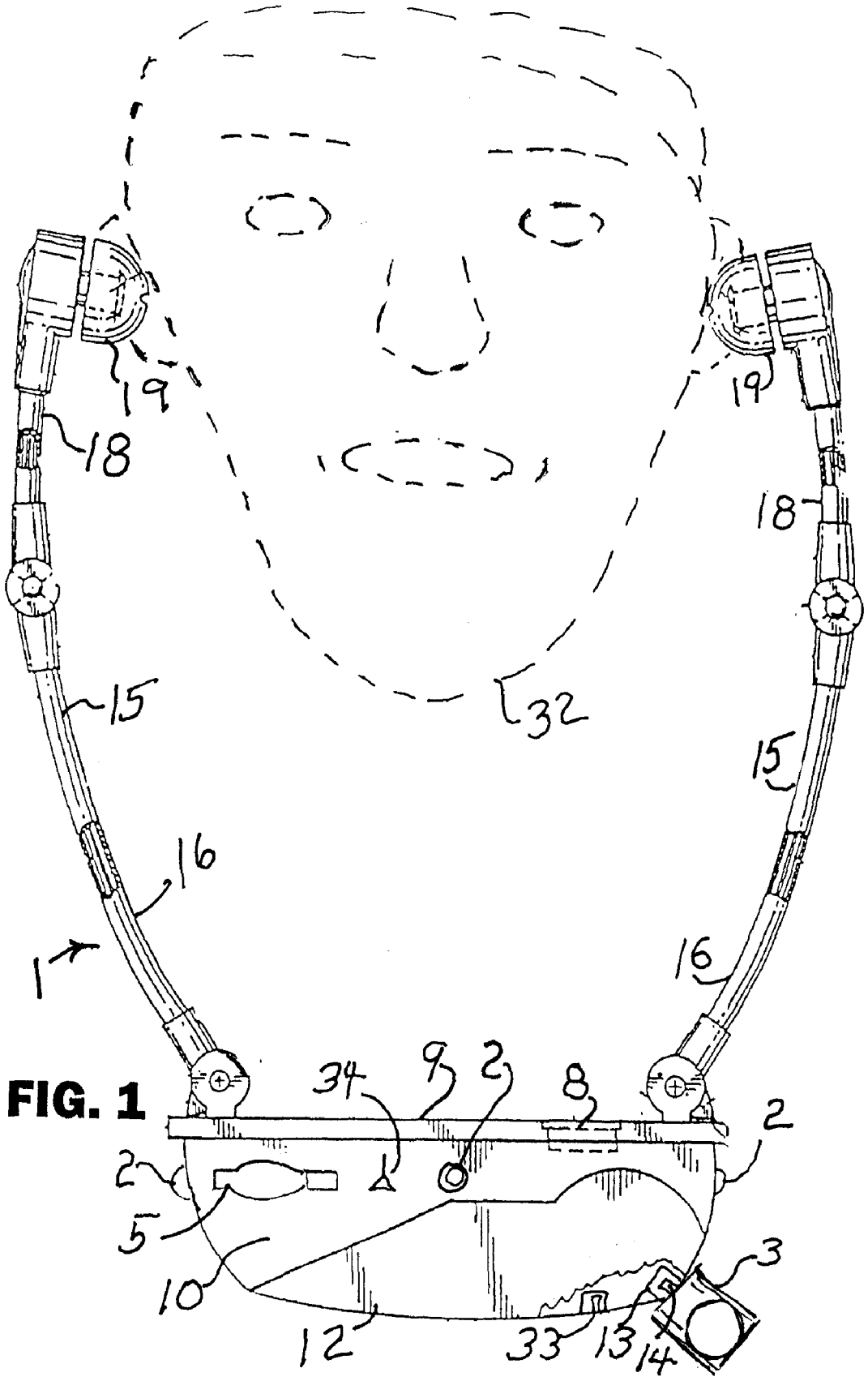
FIG. 1 is a front elevation view with parts exposed of a device of the invention in its open unfolded configuration in use on a user shown in phantom.
Figure 2:
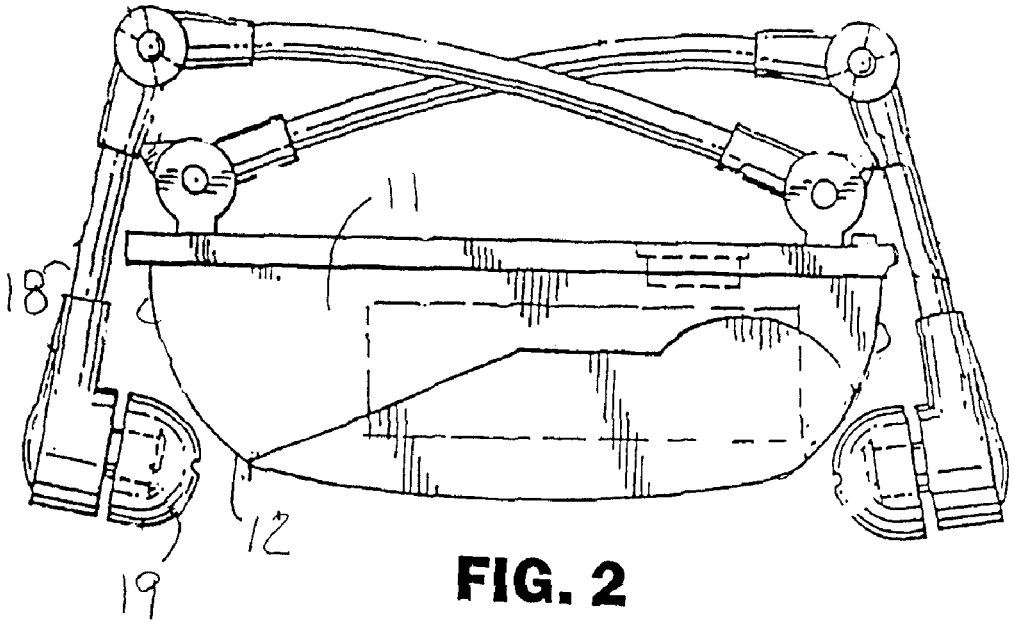
FIG. 2 is a rear view of the device in its folded compact configuration.
Figure 3:
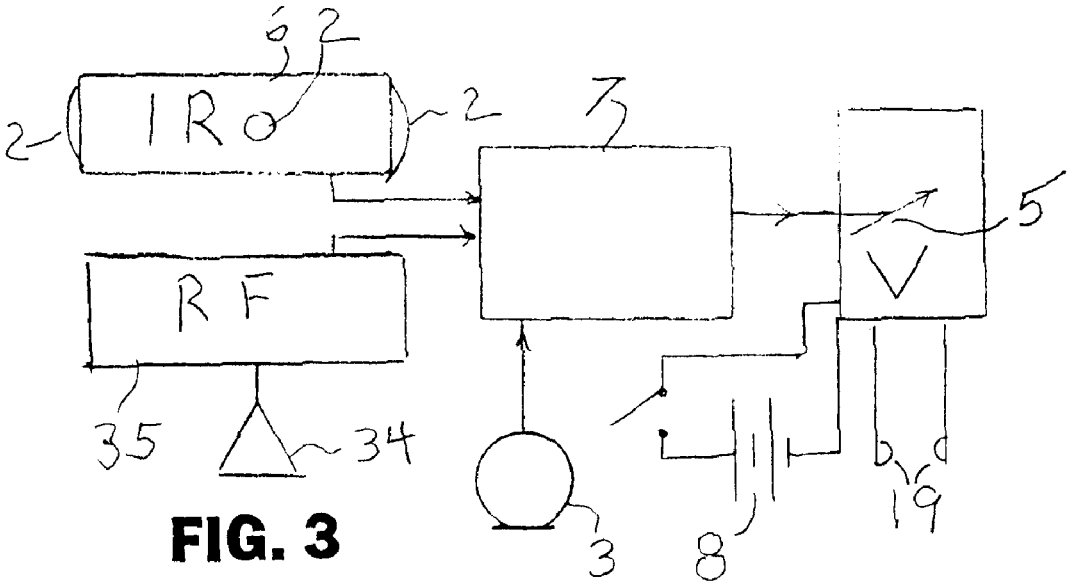
FIG. 3 is a schematic diagram of the device.
Figure 4:
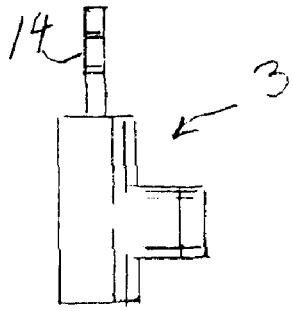
FIG. 4 is a side elevation view of a microphone of the invention.

Referring now to the drawing FIGS. 1–6, the assistive listening device 1 of the invention comprises a housing 9 containing an electric power source 8 such as a battery; an FM radio antenna 34; three infrared detectors 2 positioned on the housing surface to receive radiation from different directions to ensure reception from the straight line propagation characteristic of this type of radiation; a socket 13 to plug in a microphone 3 to hear conversations while wearing the device, the microphone being rotatable in the plug for directing the sensitivity to a particular area; radio receiver 35; infrared receiver 6; audio amplifier 7 for amplifying received signals from the microphone, the infrared receiver, and the radio receiver, and converting the signals to sound at the earphones 19.

Figure 6:
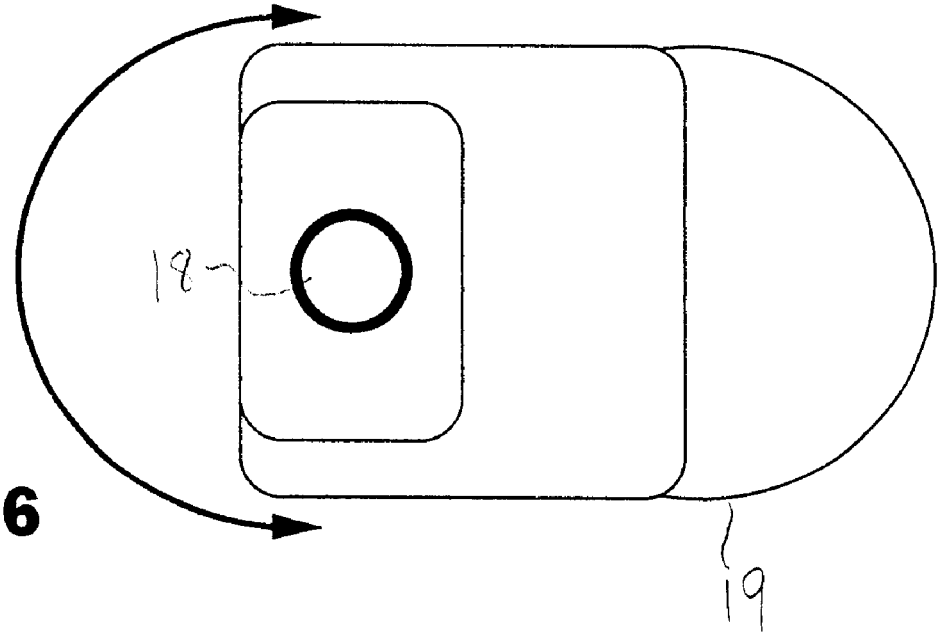
FIG. 6 is a top view of the earphone on its arm.
Figure 5:
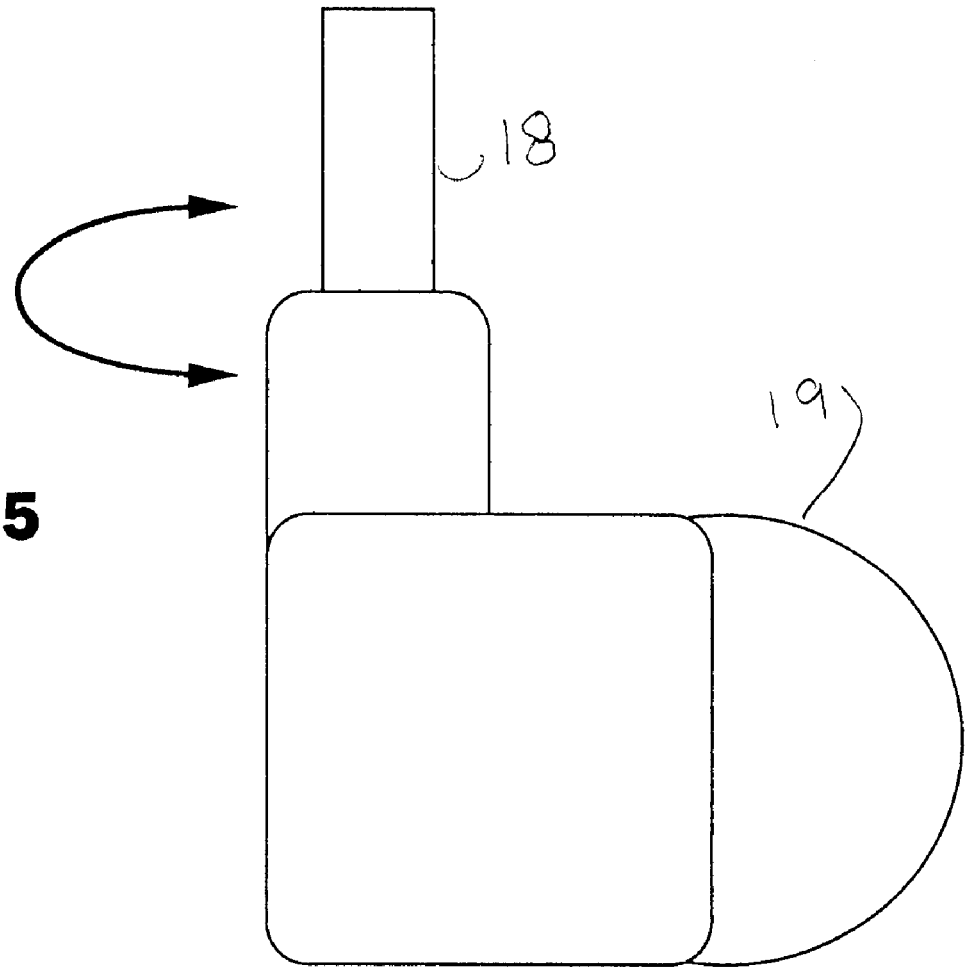
FIG. 5 is a side elevation view of the earphone of the invention on its arm.

The housing 9 has a broad front face 10 and back face 11 with the peripheries thereof joined by a perimetral edge 12 to define the enclosure. Two elongate folding arms 15 are pivotally joined at their proximal ends 16 to the housing at the edge 12. The distal ends 18 of the arms support earphones 19. As best seen in FIGS. 5 and 6, the earphone 19 is constructed to rotate on the arm 18 through a limited angle to allow it to be adjusted for maximum fit to the ears of the user.

The microphone 3 has a connecting plug 14 that plugs into a socket 13 on the edge 12 to connect it to the amplifier circuit 7. It may be disconnected when the user prefers not to be distracted by ambient conversation, and plugged in when required. It may be rotated to enhance reception in a particular direction. A dummy socket 33 may be provided to hold the microphone when not in use. Alternatively, a switch (not shown) may be used to disconnect the microphone as desired. By locating the microphone as shown where it is below the chin 32 of the user, the user's voice will not be amplified uncomfortably during a conversation. Alternatively, the housing may be positioned above the head where it may afford better reception behind a tall audience member.

While we have shown and described the preferred embodiments of our invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A self-contained assistive listening device for converting audio information transmitted on radio or infrared radiation carriers into audible sound at the ears of a user, the device comprising:

A) at least one of i) radio receiver means for receiving, amplifying and decoding said radio radiation carrier and providing therefrom an electrical audio signal containing said audio information; and ii) infrared radiation receiver means for receiving, amplifying and decoding said infrared radiation carrier and providing therefrom an electrical audio signal containing said audio information;

B) a microphone for receiving sound waves and providing therefrom an electrical audio signal;

C) signal amplifier means connected to said microphone, and said at least one of said infrared radiation receiver means and said radio receiver means for amplifying said electrical signal received therefrom;

D) volume control means connected to said amplifier means for adjusting the strength of said electrical signal from said amplifier means;

E) electric power means for connecting and providing electric power to said device;

F) a housing having broad front and back faces with the peripheries thereof joined together by a perimetral edge to define an enclosure, said enclosure containing said at least one of said radio receiver means and said infrared radiation receiver means, said signal amplifier means, said volume control means, and said electric power means, said housing removably supporting said microphone thereon;

G) a pair of elongate arms, each of said arms connected at a proximal end to said housing;

H) an earphone connected at the distal end of each of said arms and operatively connected to said signal amplifier means for converting said electrical signal into audible sound at the ears of the user;

I) the microphone being disconnectable from the amplifier means.

2. The device according to claim 1, in which the microphone is rotatable to selectively receive sound from a particular direction.

3. The device according to claim 1, in which the microphone is plugged into a socket on the perimetral edge from which it may be unplugged as desired, the microphone being rotatable in the socket to enhance directionality.

4. The device according to claim 1 further comprising a dummy socket for holding the microphone when not in use.

5. A self-contained assistive listening device for converting audio information transmitted on infrared radiation carriers into audible sound at the ears of a user, the device comprising:

A) infrared radiation receiver means for receiving, amplifying and decoding said infrared radiation carrier and providing therefrom an electrical audio signal containing said audio information;

B) a microphone for receiving sound waves and providing therefrom an electrical audio signal;

C) signal amplifier means connected to said microphone and said infrared radiation receiver means for amplifying said electrical audio signal received therefrom;

D) volume control means connected to said amplifier means for adjusting the strength of said electrical audio signal from said amplifier means;

E) electric power means for connecting and providing electric power to said device;

F) a housing having broad front and back faces with the peripheries thereof joined together by a perimetral edge to define an enclosure, said enclosure containing said infrared radiation receiver means, said audio amplifier means, said volume control means, and said electric power means, and said housing removably supporting said microphone thereon;

G) a pair of elongate arms, each of said arms connected at a proximal end to said housing;

H) an earphone connected at the distal end of said each arm and operatively connected to said audio amplifier means for converting said electrical audio signal into audible sound at the ears of the user, each said earphone rotatable on said arm through a limited angle of rotation.

6. The device according to claim 5, in which the microphone is mounted on said perimetral edge and is disconnectable from the amplifier means.

7. The device according to claim 6, in which the microphone is rotatable to selectively receive sound from a particular direction.

8. The device according to claim 5, in which the microphone is rotatable to selectively receive sound from a particular direction.

9. The device according to claim 5, in which the microphone is plugged into a socket on the perimetral edge from which it may be unplugged as desired, the microphone being rotatable in the socket to enhance directionality.

10. The device according to claim 9 further comprising a dummy socket for holding the microphone when not in use.

11. The device according to claim 5, in which the infrared radiation receiver means includes at least three infrared sensors that are positioned so as to sense radiation arriving from different directions.

12. A self-contained assistive listening device for converting audio information transmitted on infrared radiation carriers into audible sound at the ears of a user, the device comprising:

A) infrared radiation receiver means for receiving, amplifying and decoding said infrared radiation carrier and providing therefrom an electrical audio signal containing said audio information, the infrared radiation receiver means including at least three infrared sensors that are positioned so as to sense radiation arriving from different directions;

B) a microphone for receiving sound waves and providing therefrom an electrical audio signal;

C) signal amplifier means connected to said microphone and said infrared radiation receiver means for amplifying said electrical audio signal received therefrom;

D) volume control means connected to said amplifier means for adjusting the strength of said electrical audio signal from said amplifier means;

E) electric power means for connecting and providing electric power to said device;

F) a housing having broad front and back faces with the peripheries thereof joined together by a perimetral edge to define an enclosure, said enclosure containing said infrared radiation receiver means, said audio amplifier means, said volume control means, and said electric power means, and said housing removably supporting said microphone thereon;

G) a pair of elongate arms, each of said arms connected at a proximal end to said housing;

H) an earphone connected at the distal end of said each arm and operatively connected to said audio amplifier means for converting said electrical audio signal into audible sound at the ears of the user.

13. The device according to claim 12, in which the microphone is plugged into a socket on the housing from which it may be unplugged as desired, the microphone being rotatable in the socket to enhance directionality.

14. The device according to claim 13 further comprising a dummy socket for holding the microphone when not in use.

15. The device according to claim 12 in which the earphone is rotatable about the arm through a limited angle.

16. A self-contained assistive listening device for converting audio information transmitted on infrared radiation carriers into audible sound at the ears of a user, the device comprising:

A) infrared radiation receiver means for receiving, amplifying and decoding said infrared radiation carrier and providing therefrom an electrical audio signal containing said audio information, the infrared radiation receiver means including at least three infrared sensors that are positioned so as to sense radiation arriving from different directions;

B) signal amplifier means connected to said infrared radiation receiver means for amplifying said electrical audio signal received therefrom;

C) volume control means connected to said amplifier means for adjusting the strength of said electrical audio signal from said amplifier means;

D) electric power means for connecting and providing electric power to said device;

E) a housing having broad front and back faces with the peripheries thereof joined together by a perimetral edge to define an enclosure, said enclosure containing said infrared radiation receiver means, said audio amplifier means, said volume control means, and said electric power means, and said housing removably supporting said microphone theron;

F) a pair of elongate arms, each of said arms connected at a proximal end to said housing;

G) an earphone connected at the distal end of said each arm and operatively connected to said audio amplifier means for converting said electrical audio signal into audible sound at the ears of the user.

17. The device according to claim 15 in which the earphone is rotatable about the arm through a limited angle.

* * * * *